US005087175A

United States Patent [19]

Raizman et al.

[11] Patent Number: 5,087,175

[45] Date of Patent: Feb. 11, 1992

[54] GAS-JET EJECTOR

[76] Inventors: Isak A. Raizman, ulitsa Razmatullina, 4/7, kv. 52; Valery A. Pirogov, ulitsa R. Zorge, 105, kv. 81, both of Kazan, U.S.S.R.

[21] Appl. No.: 623,882

[22] PCT Filed: Mar. 17, 1989

[86] PCT No.: PCT/SU89/00068

§ 371 Date: Dec. 27, 1990

§ 102(e) Date: Dec. 27, 1990

[87] PCT Pub. No.: WO90/11450

PCT Pub. Date: Oct. 4, 1990

[51] Int. Cl.[5] ..... F04F 5/44

[52] U.S. Cl. ..... 417/196; 417/198

[58] Field of Search ..... 417/87, 196, 198

[56] References Cited

U.S. PATENT DOCUMENTS

| | | | |
|---|---|---|---|
| Re. 21,416 | 4/1940 | Sargent | 417/196 |
| 2,268,656 | 1/1942 | Haltmeier | 417/196 |
| 3,625,820 | 12/1971 | Gluntz et al. | 417/198 |
| 4,134,547 | 1/1979 | Gamst | 417/196 |

FOREIGN PATENT DOCUMENTS

| | | | |
|---|---|---|---|
| 905624 | 7/1972 | Canada | 417/196 |
| 291052 | of 1971 | U.S.S.R. . | |
| 459616 | of 1975 | U.S.S.R. . | |
| 629369 | of 1978 | U.S.S.R. . | |
| 1120115 | 11/1982 | U.S.S.R. | 417/196 |

OTHER PUBLICATIONS

V. A. Uspensky, et al. "Get Vacuum Pumps" 1973, Mashinostroenie, (Moscow), cf, p. 114 (FIG. 67).

Tsintikhimneftemash Abstracts, XM-6 Series, Criogenic & Vacuum Engineering, No. 3, 1986, Moscow, I. A. Raizman; et al. "Ejector—Backed Vacuum Pumps with Liquid Ring Seals of Foreign Make", pp. 1-3.

*Primary Examiner*—Richard A. Bertsch
*Assistant Examiner*—Michael I. Kocharov
*Attorney, Agent, or Firm*—Lilling and Lilling

[57] ABSTRACT

A gas-jet ejector has an inlet chamber designed to be connected to an evacuated space, a mixing chamber and a diffuser communicating with a vacuum pump which are all series-arranged in a direction coinciding with the direction of gas flow and in alignment with each other inside a housing. A Laval nozzle connected to the surroundings is contained inside the inlet chamber in alignment therewith. The geometry of the critical section of the Laval nozzle, its outflow section and the inlet and outlet sections of the mixing chamber is conducive to increasing the volumetric flow rate across the outlet section of the diffuser 1.35 to 1.80 times.

1 Claim, 1 Drawing Sheet

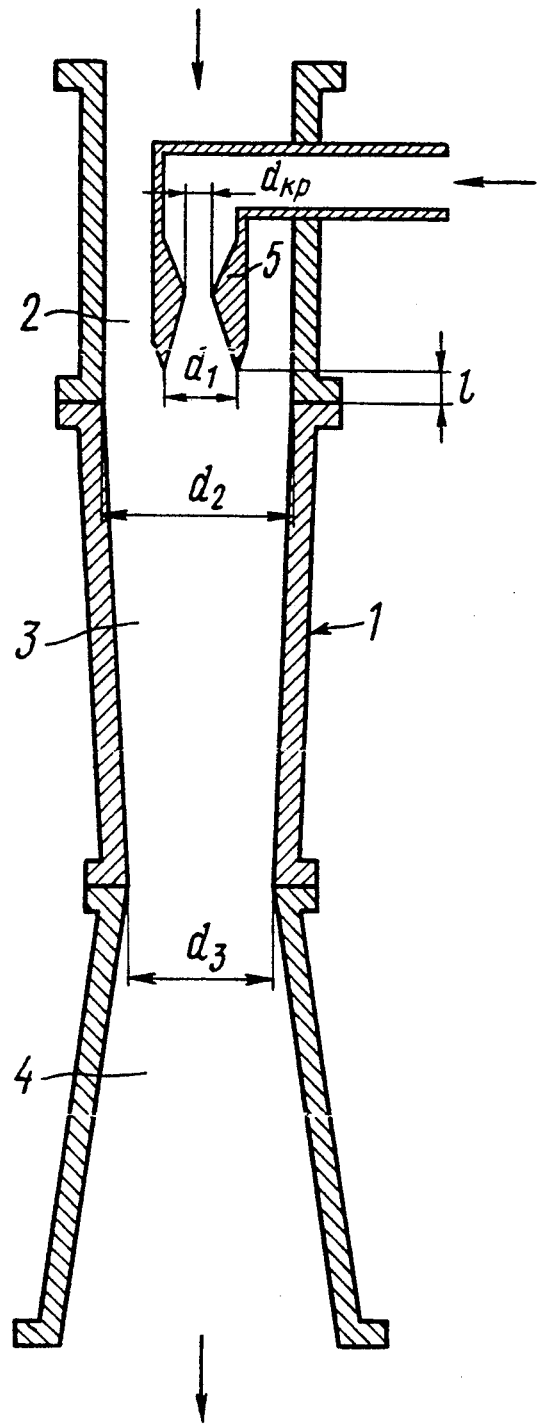
$d_{кр}$
5
2
$d_1$
l
$d_2$
3
1
$d_3$
4

GAS-JET EJECTOR

BACKGROUND OF THE INVENTION

1. Field of the Invention

The present invention relates to compressor engineering and fluidics and has specific reference to a gas-jet ejector.

2. Description of the Related Art

Known in the art is a gas-jet ejector comprising an inlet chamber, a mixing chamber and a diffuser (TSINTIKHIMNEFTEMASH Abstracts, XM-6 Series, Criogenic and Vacuum Engineering, No 3, 1986, Moscow, I. A. Raizman et. al "Ejector-Backed Vacuum Pumps With Liquid-Ring Seals of Foreign Make", pp. 1-3) which are series-arranged in alignment with each other. The inlet chamber communicates with the evacuated space and the diffuser, with a vacuum pump. A Laval nozzle communicating with the surroundings is contained inside the inlet chamber in alignment therewith. The Laval nozzle can also be connected to a delivery outlet of a vacuum pump.

The prior art gas-jet ejector creates the prospect of widening the high-vacuum region of the vacuum pump. A vacuum pump with an ultimate pressure of 5-8 kPa is capable of producing a pressure of 1-5 kPa if only one stage of the gas-jet ejector is added to the system. However, the throughput of the prior art gas-jet ejector amounts to only 0.5-0.7 of the throughput of the vacuum pump at the point of connection of the ejector.

SUMMARY OF THE INVENTION

The principal object of the present invention is to provide a gas-jet ejector which is dimensionally proportioned so as to give a throughput which is higher than ever before.

This object is realized by disclosing a gas-jet ejector comprising an inlet chamber connected to an evacuated space and containing an aligned Laval nozzle communicating with the surroundings, a mixing chamber and a diffusor connected to a vacuum pump which are all series-arranged in a direction coinciding with the direction of gas flow and in alignment with each other inside a housing, wherein, according to the invention, the geometry of the critical and outlet sections of the Laval nozzle and of the inlet and outlet sections of the mixing chamber is conducine to an increase in the volumetric flow rate across the outlet section of the diffuser by 1.35 to 1.80 times.

It is expedient that the relationship between the diameter of the critical section of the Laval nozzle and the diameters of the inlet and outlet sections of the mixing chamber and the distance from the outlet section of the Laval nozzle to the inlet section of the mixing chamber is as follows:

$d_1 = 1.8$ to $2.7\ d_{kp}$ $d_2 = 2.8$ to $5.2\ d_{kp}$ $d_3 = 2.4$ to $4.8\ d_{kp}$ $l = 2.5$ to $4.5\ d_{kp}$ where $d_1$ = diameter of the outlet section of the Laval nozzle;

$d_2$ = diameter of the inlet section of the mixing chamber;

$d_3$ = diameter of the outlet section of the mixing chamber;

$d_{kp}$ = diameter of the critical section of the Laval nozzle;

$l$ = distance from the outlet section of the Laval nozzle to the inlet section of the mixing chamber.

An optimal $d_1/d_{kp}$ relationship provides for a maximum velocity of the outflow from the Laval nozzle under a pressure of the operating gas corresponding to that of the evacuated gas. If $d_1 < 1.8\ d_{kp}$, the velocity of the operating gas and, consequently, its performance decrease. In case $d_1 > 2.7\ d_{kp}$, the pressure of the operating gas will be less than that of the evacuated gas with the result that wasteful shock waves will occur in the operating gas.

An optimal distance between the outlet section of the Laval nozzle and the inlet section of the mixing chamber locates the point where the flows of operating and evacuated gases begin to mix up. If the Laval nozzle is disposed too far from the mixing chamber ($l > 4.5\ d_{kp}$), the two flows will mix up before entering the mixing chamber and their ratio will impair the performance of the ejector. A too close distance between the Laval nozzle and the mixing chamber ($l < 2.5\ d_{kp}$) will cause the two flows to start mixing up inside the mixing chamber.

An optimal relationship between the diameter, $d_2$, of the inlet section of the mixing chamber and the diameter, $d_{kp}$, of the critical section of the Laval nozzle is conducive to an optimal relationship between the flow rates of the operating and compressed gases. If $d_2 < 2.8\ d_{kp}$, the flow rate of the evacuated gas decreases but if $d_2 > 5.2\ d_{kp}$, the flow rate of the evacuated gas increases with the result that the relative performance of the operating gas decreases.

An optimal relationship between the diameter, $d_3$, of the outlet section of the mixing chamber and the diameter, $d_{kp}$, of the critical section of the Laval nozzle defines the velocity of the gas at the end of mixing process. If $d_3 > 4.8\ d_{kp}$, the velocity of the gas increases to a point when the shock waves occuring in the course of transition from supersonic flow to subsonic flow incur significant losses. A decrease in the diameter, $d_3$, of the outlet section of the mixing chamber ($d_3 < 2.5\ d_{kp}$) leads to a decrease in the throughput of the gas-jet ejector.

BRIEF DESCRIPTION OF THE DRAWINGS

A preferred embodiment of the present invention will now be described by way of example with reference to the accompanying drawing illustrating the features of design of the disclosed gas-jet ejector.

DESCRIPTION OF THE PREFERRED EMBODIMENT

The gas-jet ejector comprises an inlet chamber 2, a mixing chamber 3 and a diffuser 4 which are all aligned in series with each other in a direction coinciding with that of gas flow and are contained in a housing 1. The diffuser 4 communicates with a vacuum pump (not shown), and the inlet chamber 2 communicates with an evacuated space (not shown) and contains a Laval nozzle 5 which is set in alignment therewith and is connected to the surroundings. The Laval nozzle 5 can be connected to the delivery outlet of a vacuum pump (not shown). The diameter, $d_1$, of the outlet section of the Laval nozzle 5 equals 1.8 to 2.7 $d_{kp}$, where $d_{kp}$ is the diameter of the critical section of the Laval nozzle 5. The diameter, $d_2$, of the inlet section of the mixing chamber 3 equals 2.8 to 5.2 $d_{kp}$, and the diameter $d_3$, of the outlet section of the mixing chamber 3 equals 2.4 to 4.8 $d_{kp}$. The distance, 1, between the outlet section of the Laval nozzle 5 and the inlet section of the mixing chamber 3 equals 2.5 to 4.5 $d_{kp}$.

The disclosed gas-jet ejector is fitted to the suction inlet of a vacuum pump (not shown).

In operation, a pressure differential between the pressure in the suction inlet of the vacuum pump (not shown) and that in the surroundings, e.g. in atmosphere, causes atmospheric air to enter the Laval nozzle 5 and accelerate there to a velocity of over 500 m/s. The acceleration of the above velocity results from the relationship $d_1/d_{kp}=1.8$ to 2.7, where $d_1$ is the diameter of the outlet section of the Laval nozzle 5 and $d_{kp}$ is the diameter of the critical section of the Laval nozzle 5. Within the distance 1 between the outlet section of the Laval nozzle 5 and the inlet section of the mixing chamber 3, which may vary between 2.5 $d_{kp}$ and 4.5 $d_{kp}$, the operating gas fully expands and the velocity profile of its flow acquires a regular shape. In the mixing chamber 3, the particles of the compressed gas entering from the inlet chamber 2 are entrained by the flow of the operating gas, and at the end of the mixing chamber 3 the velocity of operating gas decreases while that of the compressed gas increases so that a flow with equal velocities is formed. A properly chosen diameter $d_2$ of the inlet section of the mixing chamber 3, which may be between 2.8 $d_{kp}$ and 5.2 $d_{kp}$, ensures an optimal quantitative ratio between the flows of operating and compressed gases. A diameter $d_3$ of the outlet section of the mixing chamber 3 which is anywhere between 2.4 $d_{kp}$ and 4.8 $d_{kp}$ slightly reduces the velocity of mixed flow and minimizes the losses due to the shock waves occuring in the diffuser 4 of the gas-jet ejector during the transition from supersonic velocity to subsonic velocity. The vacuum pump (not shown) brings about a rarefaction of the flow across the outlet section of the diffuser 4 which serves to maintain the pressure differential in the Laval nozzle 5.

The disclosed gas-jet ejector was employed to create a vacuum in the Tokmak-15 fusion reactor which absolutely prevented migration of oil from the pump into the reactor. The disclosed gas-jet ejector was also used in conjunction with electric vacuum furnaces for melting highly reactive metals and alloys. A single-stage gas-jet ejector of the disclosed type can significantly reduce the size of the vacuum pump it is employed to back up and also reduce the requirements in power and water by a factor of 1.35 to 1.80 compared with its most advanced analogues from abroad. The comparable savings in power and water can increase 2.5 to 4 times if a two-stage gas-jet ejector is used which is capable of producing a pressure of 70–150 Pa sufficient for maintaining an oil-free vacuum.

The present invention holds out special promise when employed as a forevacuum stage of oilfree vacuum systems used in melting highly reactive metals and alloys. Fusion reactors and the food industry are other possible fields of its application.

We claim:

1. A gas-jet ejector, comprising:

an inlet chamber adapted for connection to a space to be evacuated;

a Laval nozzle having a critical section and an outlet section, the Laval nozzle being contained and aligned within the inlet chamber and communicating with the surroundings;

a mixing chamber having an inlet section and an outlet section; and a diffuser adapted for connection to a vacuum pump, the inlet chamber, mixing chamber and diffuser being series-arranged in a direction coinciding with a direction of gas flow and in alignment with each other inside a housing, a relationship between a diameter ($d_{kp}$) of the critical section of the Laval nozzle and diameters ($d_1$, $d_2$) of the inlet section and the outlet section of the mixing chamber and a distance (1) from the outlet section of the Laval nozzle and the inlet section of the mixing chamber being as follows:

$d_1=1.8\text{–}2.7\ d_{kp}$ $d_2=2.8\text{–}5.2\ d_{kp}$ $d_3=2.5\text{–}4.5\ d_{kp}$ $l=2.5\text{–}4.5\ d_{kp}$;

wherein $d_1$=the diameter of the outlet section of the Laval nozzle;

$d_2$=the diameter of the inlet section of the mixing chamber;

$d_3$=the diameter of the outlet section of the mixing chamber;

$d_{kp}$=the diameter of the critical section of the Laval nozzle; and $l$=the distance from the outlet section of the Laval nozzle to the inlet section of the mixing chamber.

* * * * *